US009846004B2

(12) United States Patent
Micllef

(10) Patent No.: US 9,846,004 B2
(45) Date of Patent: Dec. 19, 2017

(54) EASY LOADING MAGAZINE

(71) Applicant: Mike Micllef, Toledo, IA (US)

(72) Inventor: Mike Micllef, Toledo, IA (US)

( * ) Notice: Subject to any disclaimer, the term of this patent is extended or adjusted under 35 U.S.C. 154(b) by 0 days.

(21) Appl. No.: 15/386,303

(22) Filed: Dec. 21, 2016

(65) Prior Publication Data

US 2017/0176120 A1 Jun. 22, 2017

Related U.S. Application Data

(60) Provisional application No. 62/270,316, filed on Dec. 21, 2015.

(51) Int. Cl.
*F41A 9/67* (2006.01)
*F41A 9/66* (2006.01)

(52) U.S. Cl.
CPC . *F41A 9/67* (2013.01); *F41A 9/66* (2013.01)

(58) Field of Classification Search
CPC ..... F41A 9/61; F41A 9/64; F41A 9/65; F41A 9/66; F41A 9/67; F41A 9/83
See application file for complete search history.

(56) References Cited

U.S. PATENT DOCUMENTS 1,245,499 A * 11/1917 Orme ..... F41A 9/67 124/52
4,329,802 A * 5/1982 Coonan ..... F41A 9/67 42/50
4,488,371 A * 12/1984 Boyles ..... F41A 9/66 42/87
4,614,052 A * 9/1986 Brown ..... F41A 9/65 42/50
5,309,660 A * 5/1994 Blackamore ..... F42B 33/14 42/106
5,402,594 A * 4/1995 Switzer ..... F41A 9/83 42/87
5,568,696 A * 10/1996 Mauch ..... F41A 9/71 42/49.02
8,307,578 B1 * 11/2012 Azhocar ..... F41A 17/38 42/108
9,010,004 B1 * 4/2015 Fu ..... F41A 17/38 42/49.01
9,057,570 B1 * 6/2015 Tal ..... F41A 9/83
9,151,555 B1 * 10/2015 Huang ..... F41A 11/00
9,400,006 B1 * 7/2016 Huang ..... F16B 19/02
2011/0005115 A1 * 1/2011 Cahill ..... F41A 9/66 42/49.01

(Continued)

*Primary Examiner* — Derrick R Morgan
(74) *Attorney, Agent, or Firm* — Mark David Torche; Patwrite Law

(57) ABSTRACT

An easy loading magazine has a magazine tube with a follower that is spring biased to feed cartridges to a firearm. The follower has a follower engagement opening within it that is sized to fit the specific caliber cartridge being used in the magazine. The user places the cartridge within the follower engagement opening and uses the cartridge to force the follower down thus relieving the pressure against the cartridges to be loaded. After the cartridges are loaded within the magazine, the user removes the cartridge that was inserted in the follower engagement opening and this re-engages the follower. In one embodiment, a locking slot is provided that allows the user to temporally lock the follower in place while loading the magazine and then sliding the cartridge back to release the follower.

4 Claims, 10 Drawing Sheets

(56) References Cited

U.S. PATENT DOCUMENTS

| | | | | |
|---|---|---|---|---|
| 2011/0107639 | A1* | 5/2011 | Douglas | F41A 9/67<br>42/50 |
| 2011/0308128 | A1* | 12/2011 | Wright | F41A 9/65<br>42/50 |
| 2014/0090283 | A1* | 4/2014 | Gomez | F41A 3/26<br>42/25 |
| 2014/0223792 | A1* | 8/2014 | Socivoi | F41A 9/82<br>42/50 |
| 2014/0283427 | A1* | 9/2014 | Castro | F41A 9/67<br>42/49.01 |
| 2014/0373416 | A1* | 12/2014 | Barnhart | F41A 9/67<br>42/50 |
| 2016/0216055 | A1* | 7/2016 | Wilkinson | F41A 5/28 |

* cited by examiner

EASY LOADING MAGAZINE

CROSS REFERENCE TO RELATED APPLICATIONS

This application claims priority and herein incorporates by reference U.S. provisional patent application 62/270,316, filed Dec. 21, 2015.

BACKGROUND OF THE INVENTION

The earliest known firearm was probably the fire lance which was invented in China. It used a primitive form of gunpowder with shrapnel inserted in a bamboo barrel. Eventually as improvements were made, the barrel became metal, the shrapnel was replaced with projectiles made to fit the barrel and the gunpowder was improved to maximize the explosive power. This allowed the gun to revolutionize weaponry and the sword and shield that had existed for thousands of years gave way to modern warfare.

Although these improvements allowed the gun to be more and more deadly, the firearms of the time had the major disadvantage of taking much longer than a sword to be ready for use again. Early attempts to overcome this were generally focused on multiple barrels which could be preloaded and fired in succession. This helped but also increased the weight and complexity of the gun and the weight increase limits the number of barrels you can reasonably use.

As improvements to ammunition came, the time required to place a new cartridge to be fired in a single barrel was reduced and improvements like the "repeating rifle" allowed multiple shots to be fired with very little time between reloading. In order to feed these new cartridges to the firearm, spring loaded magazines were provided that moved the cartridge into position. Today, most rifles and handguns (not revolvers) utilize a magazine with a clip that holds the ammunition and feeds it as needed. Generally this is done by using a spring of some kind to provide the biasing force to move the cartridge into a firing position within the barrel. In most firearms that use a magazine, it is necessary to load the magazine by pushing down on the biasing spring using the cartridges to be loaded. Because of this, it gets harder to push down as each cartridge is loaded. It can be difficult and awkward especially in high capacity magazines which can hold more than 10 rounds.

There is a need for a safe and easy to use magazine that allows the user to load the magazine without having to press down on the cartridges being loaded which makes further loading more difficult.

SUMMARY OF THE INVENTION

An easy loading magazine has a magazine tube with a follower that is spring biased to feed cartridges to a firearm. The follower has a follower engagement opening within it that is sized to fit the specific caliber cartridge being used in the magazine. The user places the cartridge within the follower engagement opening and uses the cartridge to force the follower down thus relieving the pressure against the cartridges to be loaded. After the cartridges are loaded within the magazine, the user removes the cartridge that was inserted in the follower engagement opening and this re-engages the follower. In one embodiment, a locking slot is provided that allows the user to temporally lock the follower in place while loading the magazine and then sliding the cartridge back to release the follower.

Other features and advantages of the instant invention will become apparent from the following description of the invention which refers to the accompanying drawings.

DETAILED DESCRIPTION OF THE INVENTION

Figure 1:
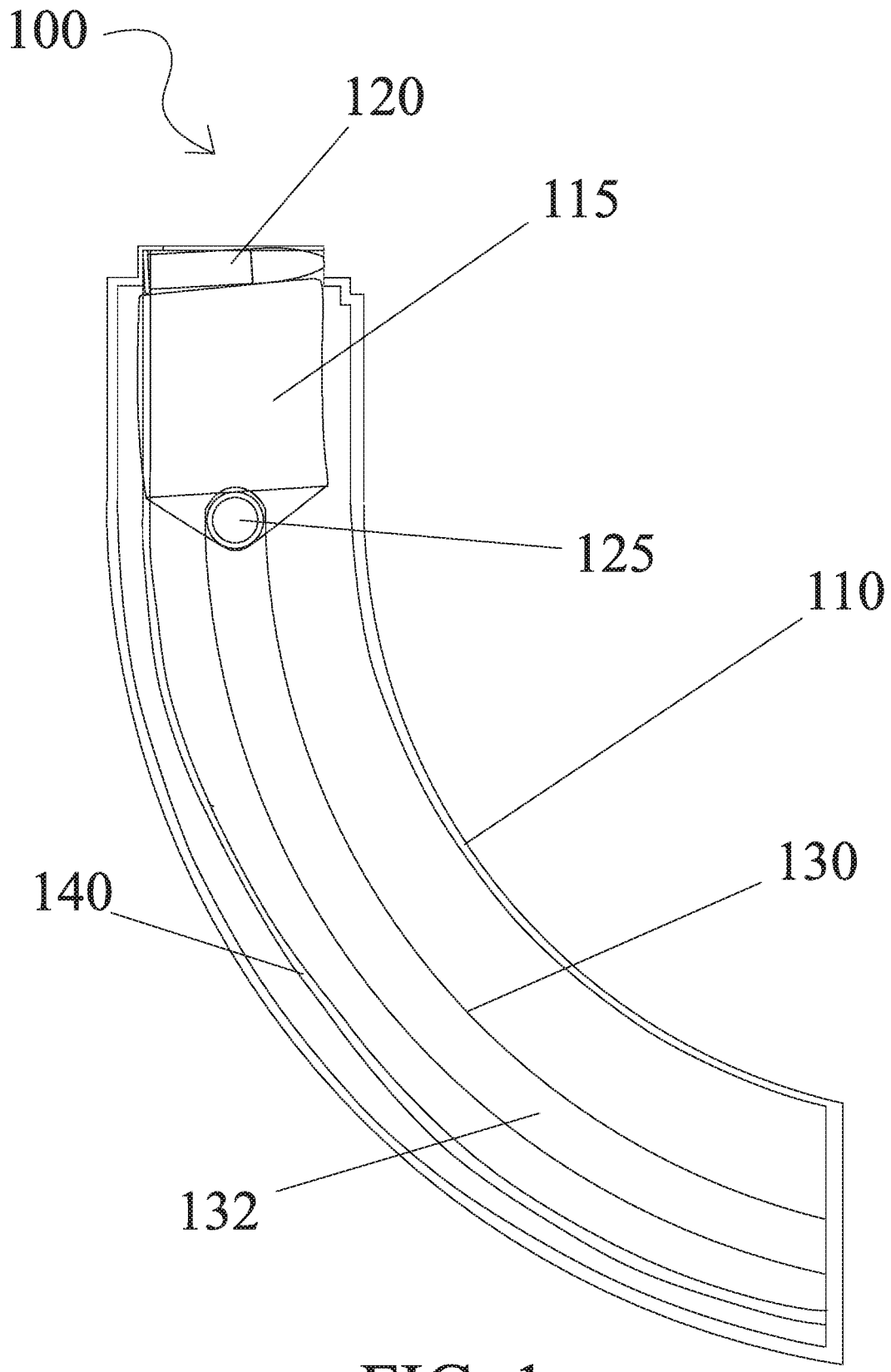
FIG. 1 is a transparent side view of an easy loading magazine according to an embodiment of the invention.
Figure 2:
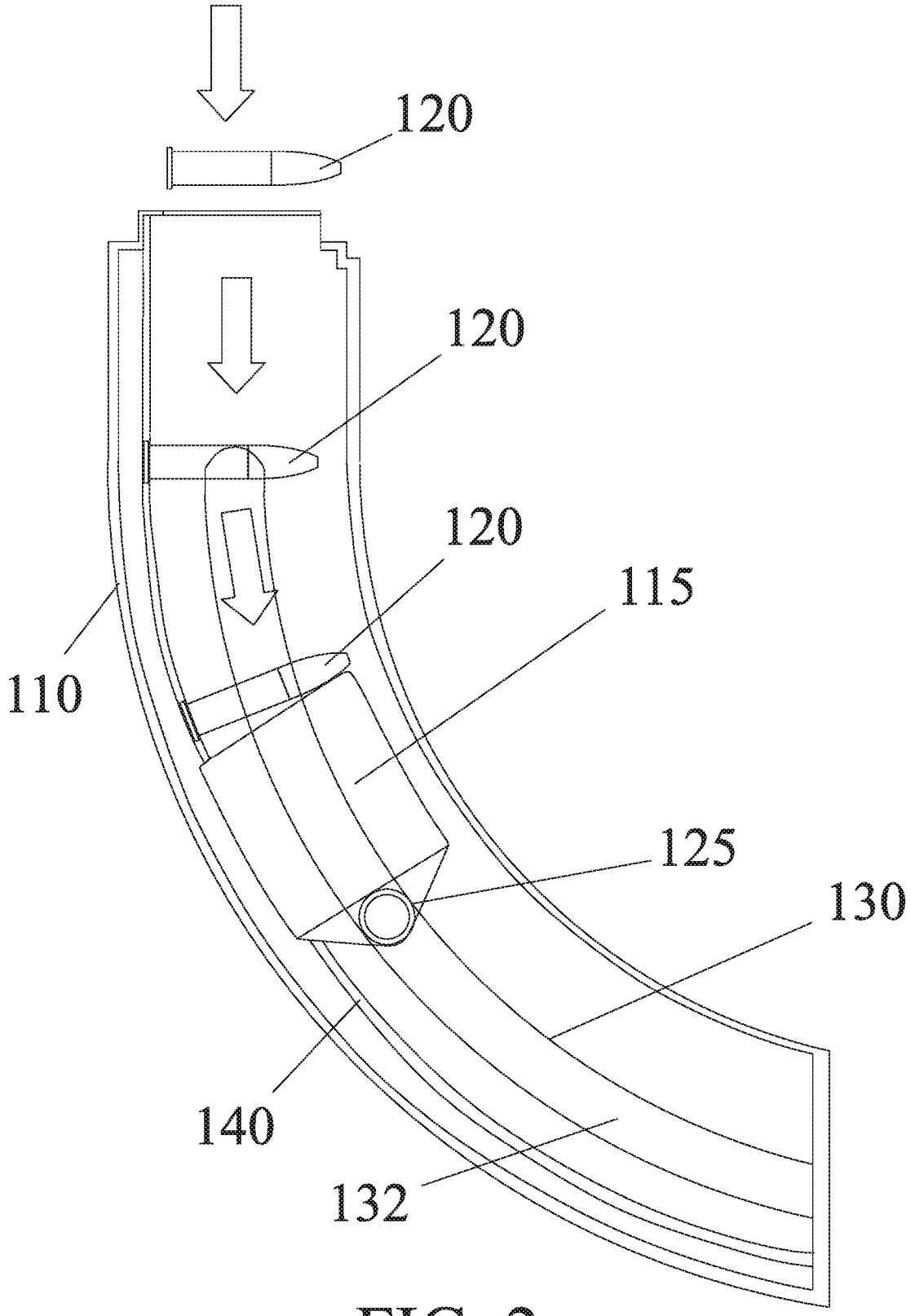
FIG. 2 is a transparent side view of the easy loading magazine shown in FIG. 1 being loaded.
Figure 3:
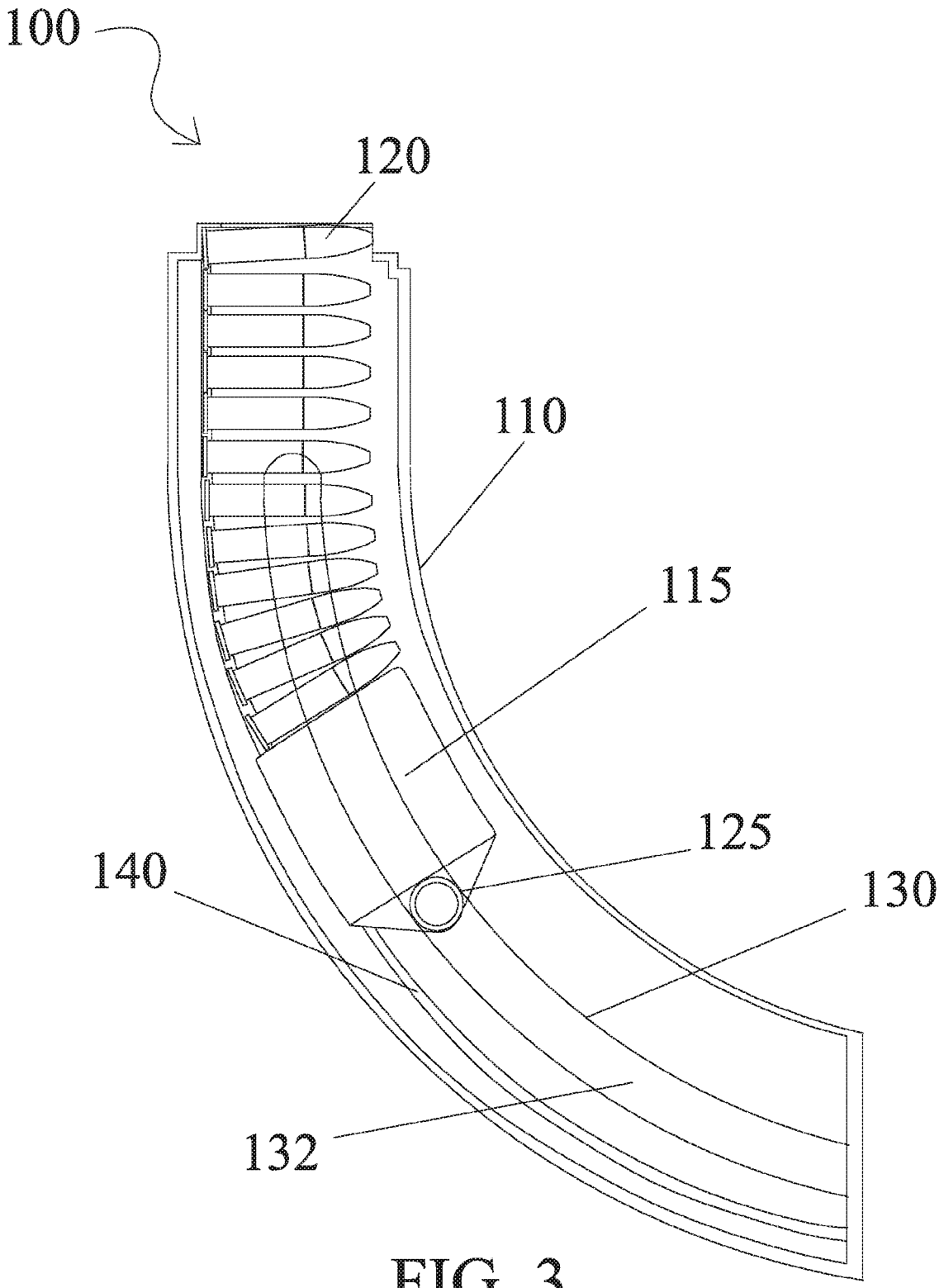
FIG. 3 is a transparent side view of the easy loading magazine shown in FIG. 1 after loading.
Figure 4:
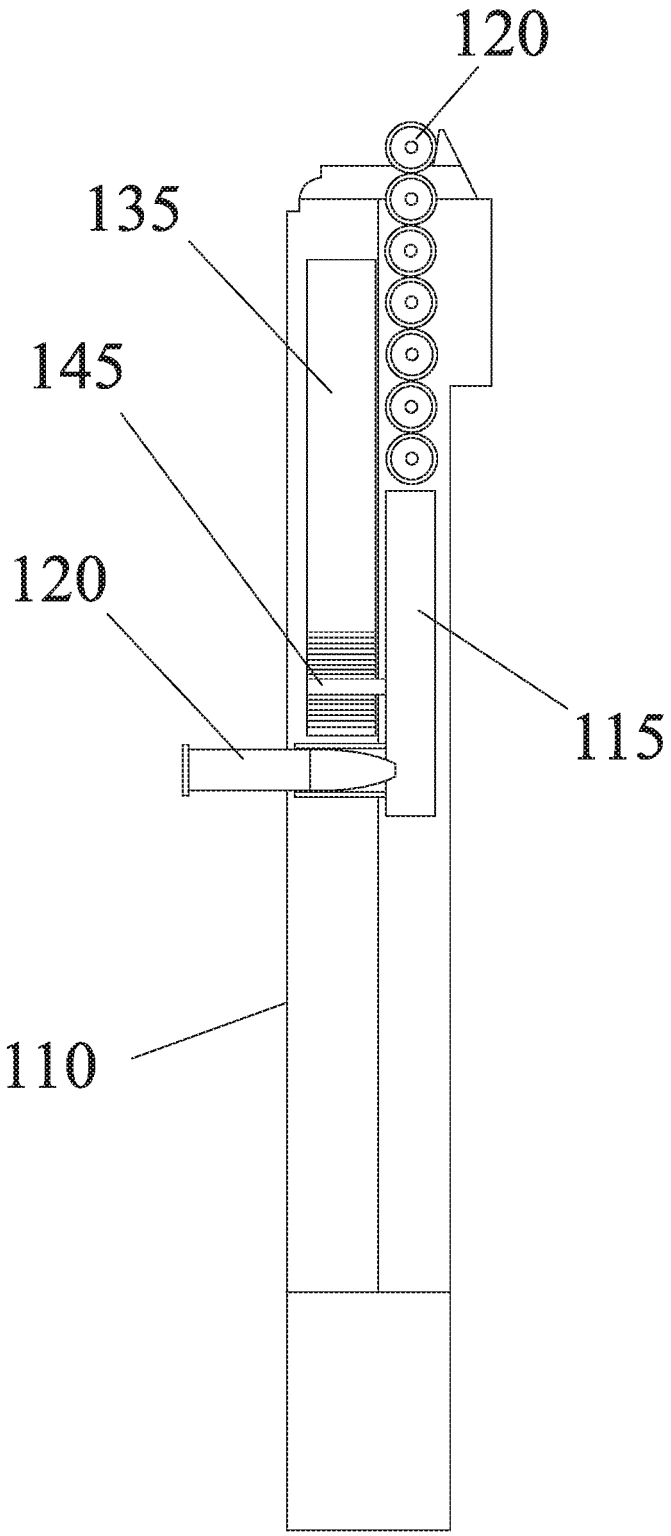
FIG. 4 is a transparent front view of the easy loading magazine shown in FIG. 1.

In the following detailed description of the invention, reference is made to the drawings in which reference numerals refer to like elements, and which are intended to show by way of illustration specific embodiments in which the invention may be practiced. It is understood that other embodiments may be utilized and that structural changes may be made without departing from the scope and spirit of the invention.

Referring to FIGS. 1-4, an easy loading magazine 100 is shown having a magazine tube 110 with a follower 115 that is resiliently biased with a spring 135. Follower 115 forces a cartridge 120 into position to be fired in a firearm (not shown). In the embodiment shown, spring 135 is a tape spring that is wrapped around a spring spool 145 and is locked in place within magazine tube 110 and unwinds as follower 115 is moved down along a track 130. Spring 135 provides the biasing force to feed cartridges 120 to the firearm. Cartridges 120 fits within a cartridge track 140 to aid in positioning them as they are loaded within magazine tube 110. The biasing force increases proportionally as it unrolls and as a consequence, more force is required to unroll it further. This requires the user to supply more force as each cartridge 120 is loaded in conventional magazines.

A follower engagement opening 125 is provided to allow a user to insert a cartridge 120 within to manually force spring 135 down without having to push down on a cartridge 120 to move follower 115 down. The user simply places cartridge 120 within follower engagement opening 125 and then moves follower 115 down along a track opening 132 by pushing on cartridge 120 which temporarily relieves the biasing force on follower 115 which allows the user to simply feed cartridges 120 within easy loading magazine 100. Track opening 132 is provided to allow cartridge 120 to move down along magazine tube 110. Once loaded, the user removes cartridge 120 which re-engages follower 115 which feeds cartridges 120 as in a conventional magazine.

Figure 5:
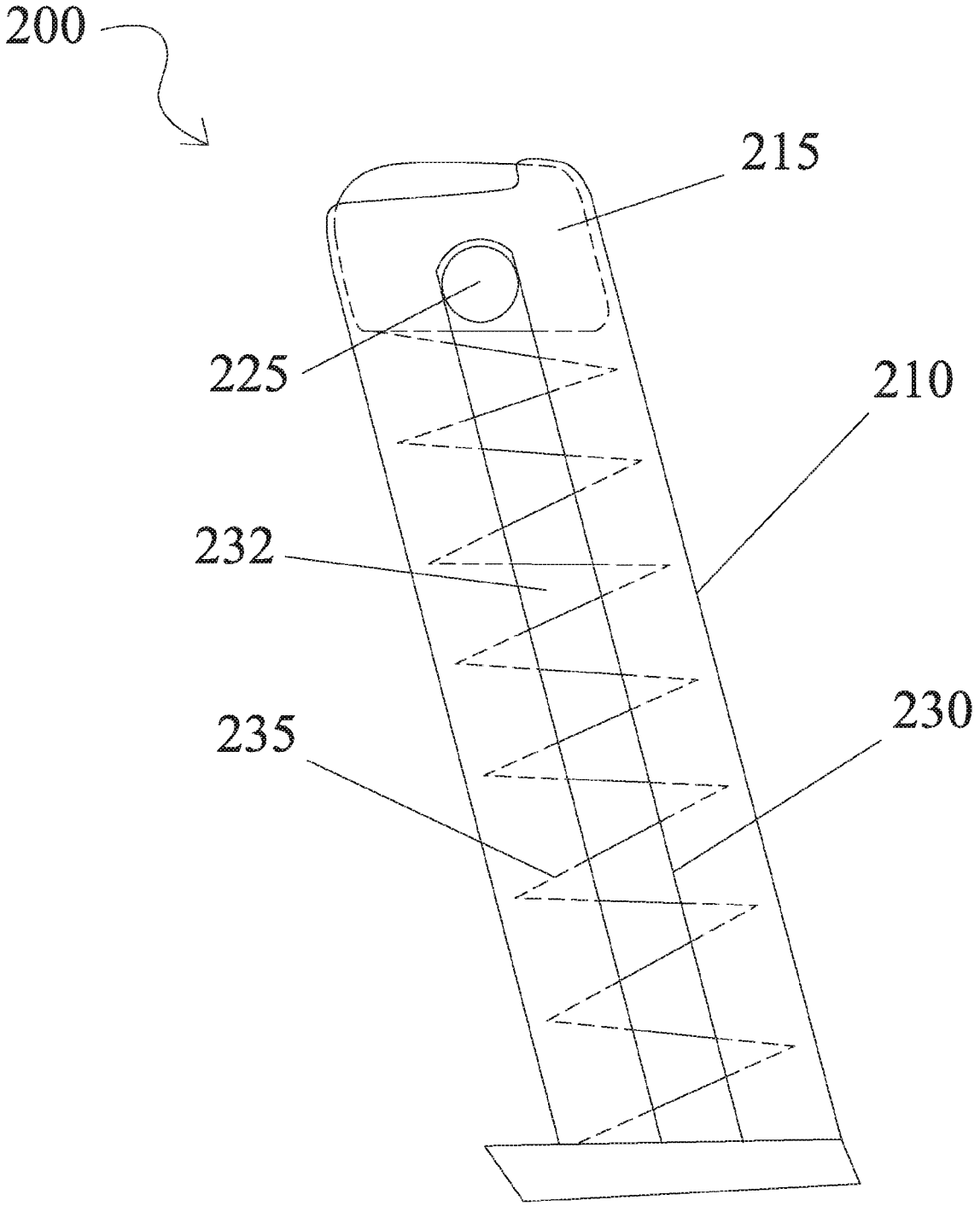
FIG. 5 is a transparent side view of an easy loading magazine for a hand gun according to an embodiment of the invention.
Figure 6:
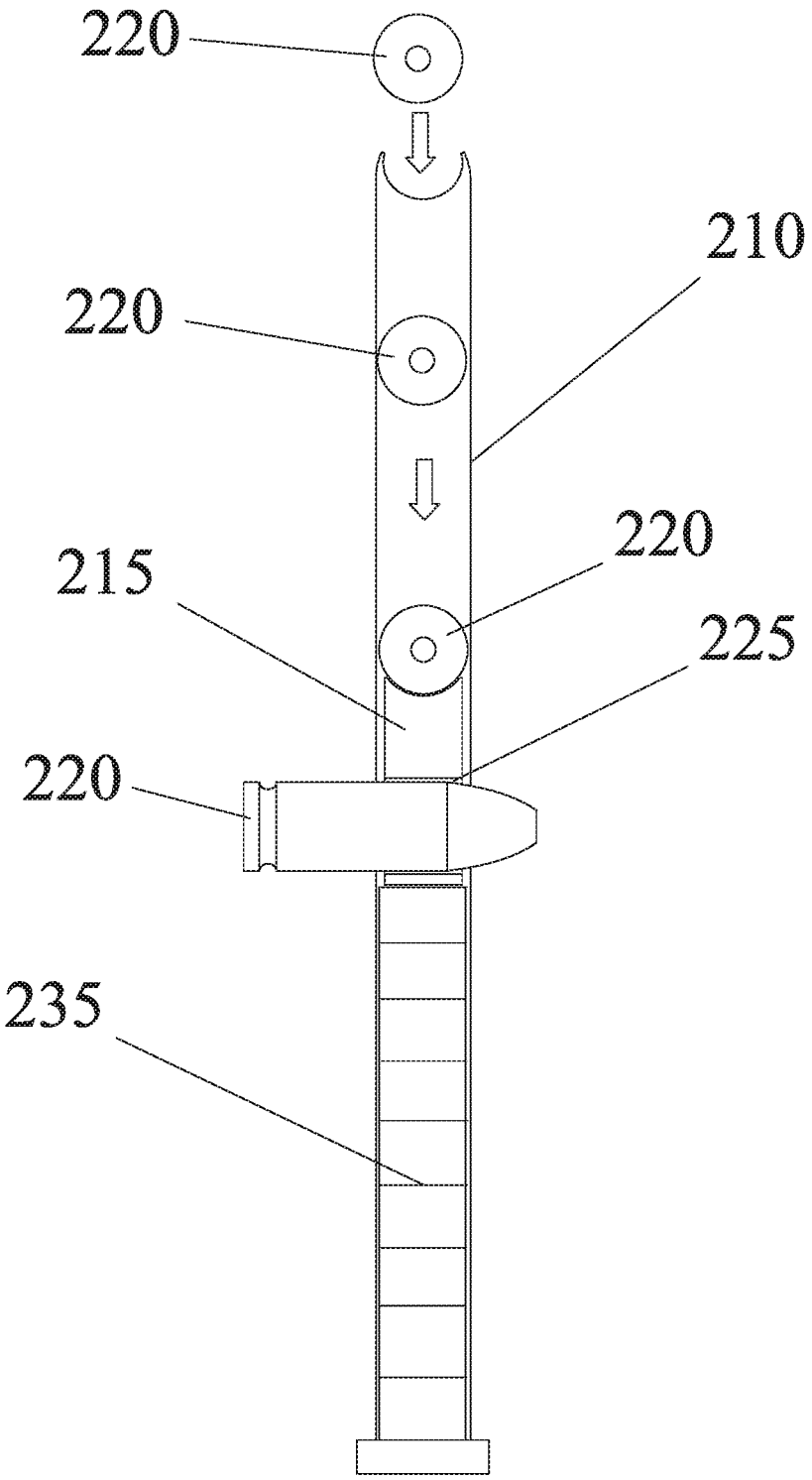
FIG. 6 is a transparent cutaway front view of the easy loading magazine shown in FIG. 5 being loaded.
Figure 7:
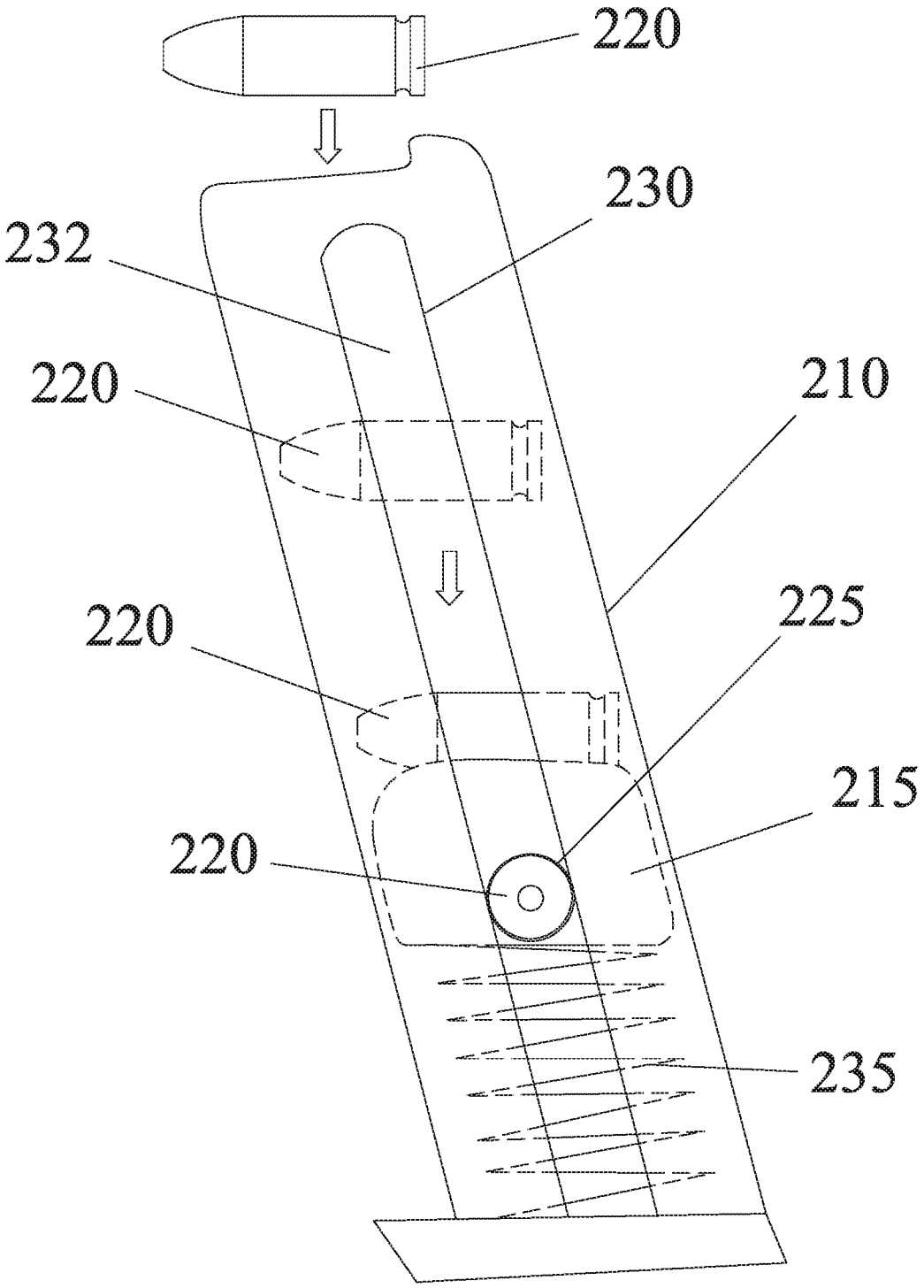
FIG. 7 is a transparent side view of the easy loading magazine shown in FIG. 6.

Now referring to FIGS. 5-7, an easy loading magazine 200 is shown having a magazine tube 210 which houses a follower 215 which is biased by a spring 235. Spring 235 provides the biasing force on follower 215 to feed a cartridge 220 to the firearm (not shown). A track 230 is provided to help guide follower 215 within magazine tube 210. A follower engagement opening 225 is provided to allow a user to insert cartridge 220 within and to force follower 215 down thus releasing the biasing force on follower 215 which allows the user to easily load cartridges 220. Once loaded, the user removes cartridge 220 and this re-engages follower 215 which allows easy loading magazine to function normally.

Figure 8:
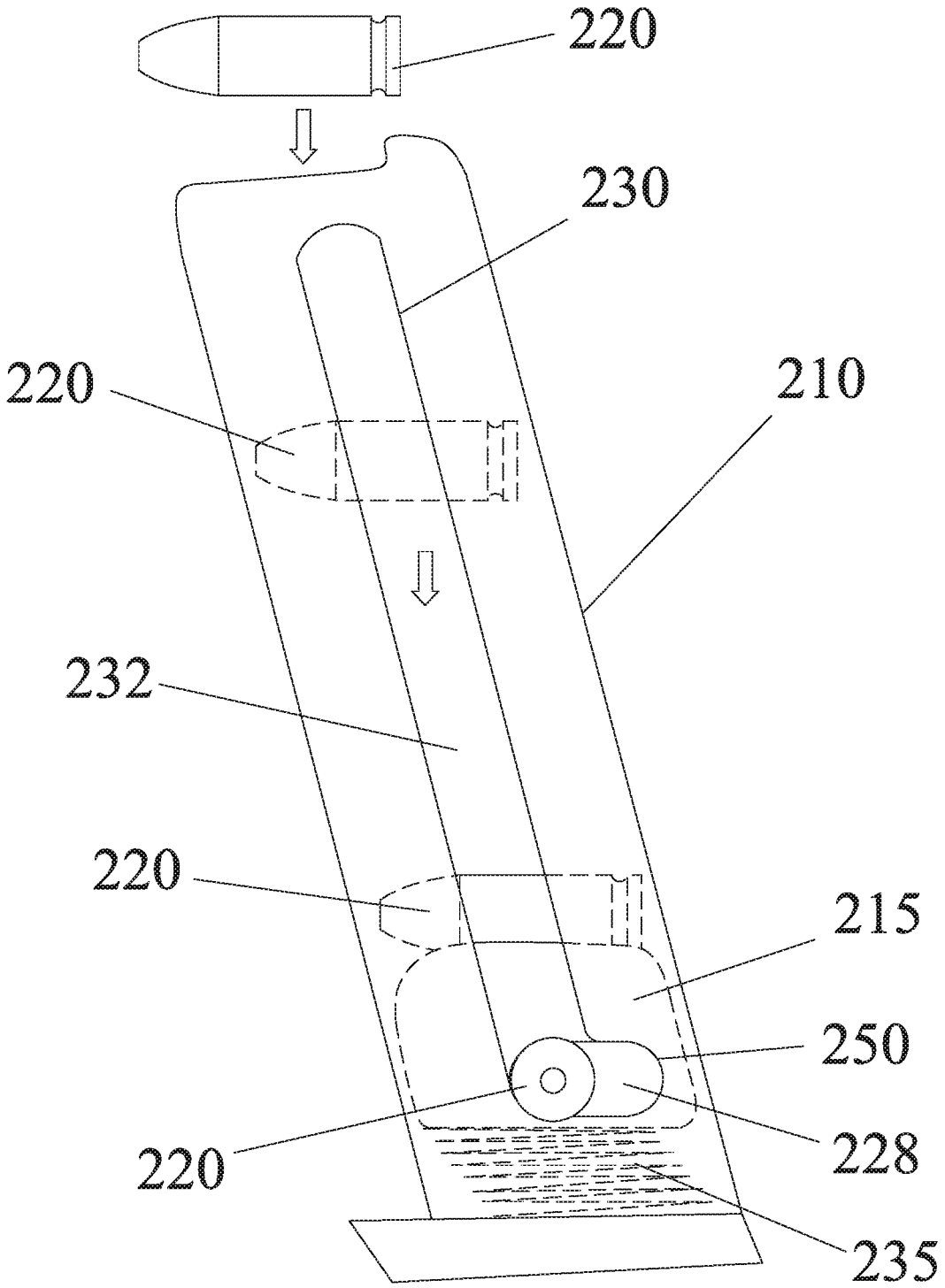
FIG. 8 is a side transparent view of the easy loading magazine shown in FIG. 5 with a locking slot.
Figure 9:
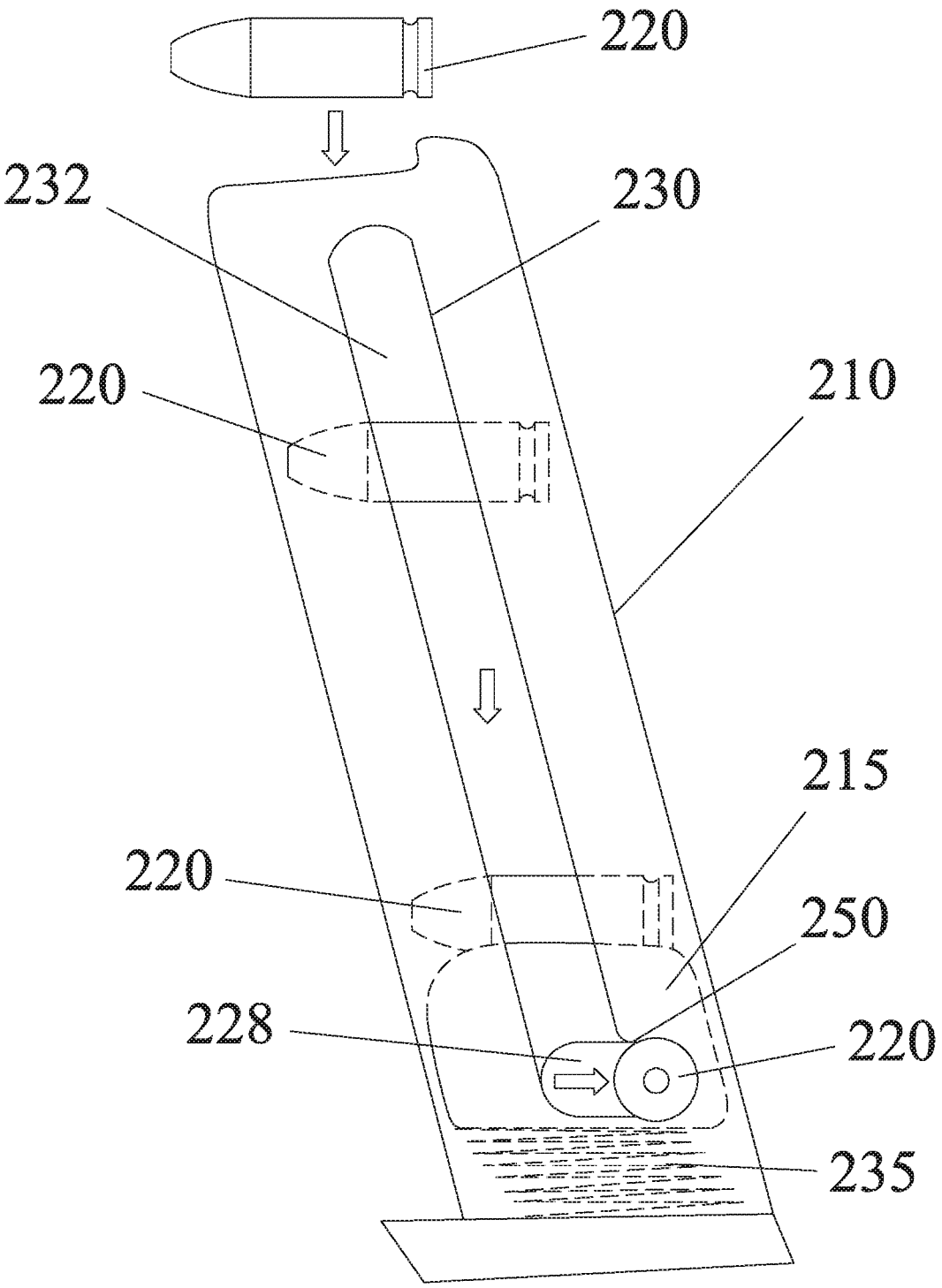
FIG. 9 is a side transparent view of the easy loading magazine shown in FIG. 8 in a locked position.

Now referring to FIGS. 8 and 9, easy loading magazine 200 is shown having a locking slot 250 which allows the user to force follower 215 down and then lock it in position while loading cartridges 220 by sliding it into locking slot 250. Locking slot 250 is part of track opening 232 and is at ninety degrees from track opening 232 which allows locking. Follower 215 has a follower engagement slot opening 228 that allows the user to slide cartridge 220 into locking slot 250 when follower 215 is moved to the proper locking position. Once loaded, the user slides cartridge 220 back from the locked position to re-engage follower 215 as described above.

Magazine tubes 110 and 210 respectively; may be made of plastic, steel or other suitable material as is known in the art. The springs used to provide the biasing force may be tape, coil, leaf, wire or any other suitable spring type as is known in the art.

Follower engagement openings 125 and 225 and follower engagement slot opening 228 respectively, are made to fit the specific caliber of cartridge being used by the corresponding magazine. This allows the user to operate the magazine without any special tools other than the proper ammunition that fits within the magazine.

Figure 10:
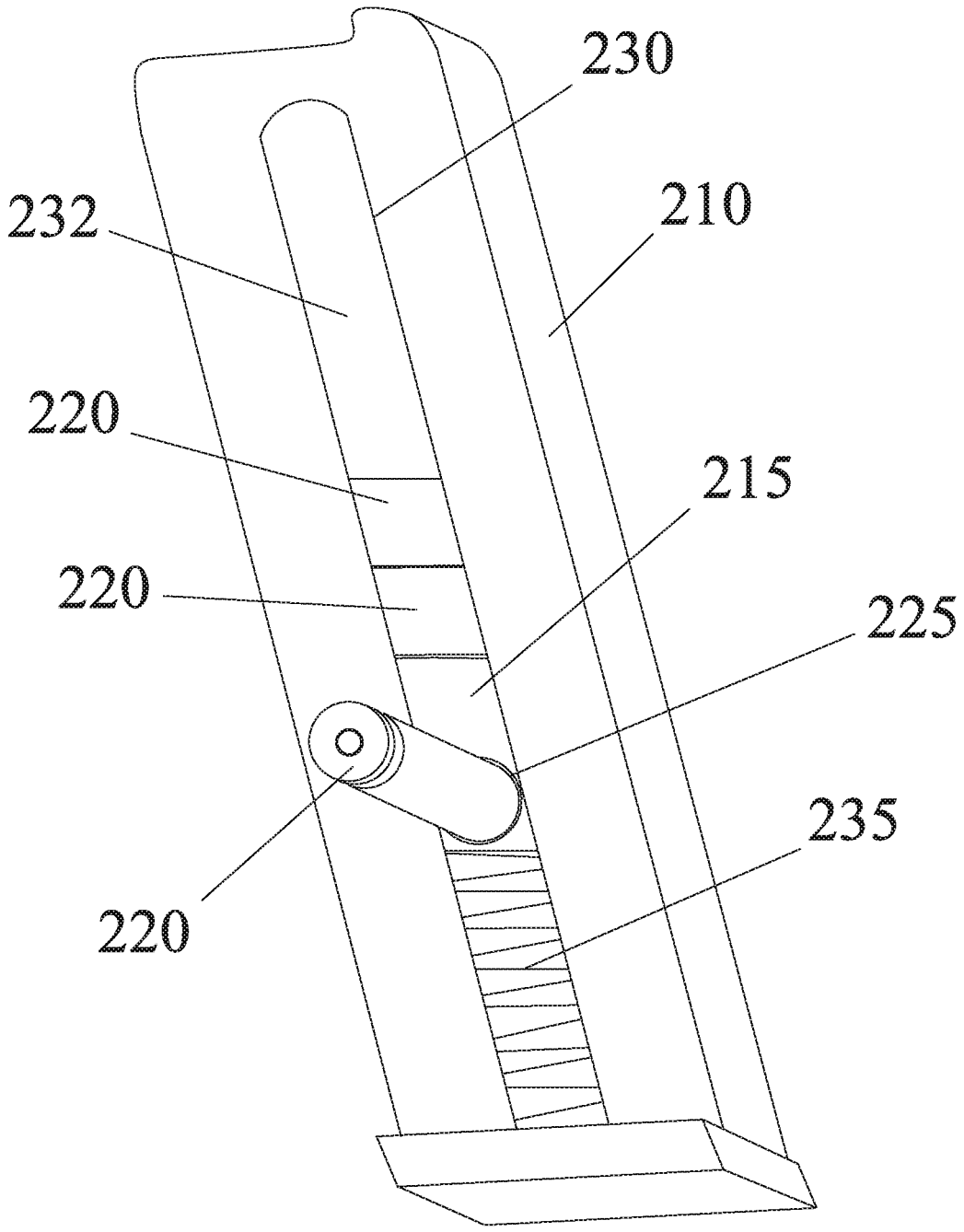
FIG. 10 is a perspective view of the easy loading magazine shown in FIG. 6.

Referring to FIG. 10, a perspective view of magazine 210 showing cartridge 220 inserted in follower engagement opening 225 to push follower 215 down compressing spring 235 which allows the user to easily insert cartridges 220. Of course, while shown with magazine 210, it is understood that the present invention is readily usable with any magazine that uses a follower resiliently biased to advance cartridges.

Easy loading magazine 100 is made from sheet metal or any suitable material such as, but not limited to plastic, composite or other suitable material as is known in the art. The specific configuration of the feeding mechanism that feeds the ammunition to the specific firearm being used is understood to match the selected firearm and is well known in the art. The instant invention is understood to be adaptable to any firearm that uses a magazine and can easily be made available as an after-market option since the instant magazine does not add any incompatible parts that would interfere with the normal insertion of a typical magazine.

Although the instant invention has been described in relation to particular embodiments thereof, many other variations and modifications and other uses will become apparent to those skilled in the art.

What is claimed is:

1. An easy loading magazine for use in a firearm comprising;

a magazine tube;

said magazine tube having a track therein;

said track adapted to hold a plurality of cartridges;

each of said cartridges having a caliber to match said firearm;

said magazine tube having a track opening;

a follower moveably disposed within said magazine tube;

a spring disposed below said follower and adapted to resiliently bias said follower wherein said follower is forced upward along said track;

a follower engagement opening disposed within said follower;

said follower engagement opening having a diameter selected to accept said caliber; and a cartridge of said caliber removably inserted in said follower engagement opening while reloading said magazine.

2. The easy loading magazine according to claim 1 wherein said spring is a tape spring.

3. The easy loading magazine according to claim 1 wherein said spring is a leaf spring.

4. An easy loading magazine for use in a firearm comprising;

a magazine tube;

said magazine tube having a track therein;

said track adapted to hold a plurality of cartridges;

said magazine tube having a track opening;

a follower moveably disposed within said magazine tube;

a spring disposed below said follower and adapted to resiliently bias said follower wherein said follower is forced upward along said track; and a follower engagement slot opening disposed within said follower;

said follower engagement slot opening having a diameter selected to match a cartridge;

said cartridge having a caliber selected to match said firearm and removably inserted in said follower engagement opening while reloading said magazine;

a locking slot disposed on a bottom portion of said track opening; and said locking slot being disposed at an angle of at least ninety degrees from said track opening wherein said cartridge is slidably disposed into said locking slot when said follower is moved to a locking position.

* * * * *